US011617452B2

(12) United States Patent
Goldsmith et al.

(10) Patent No.: US 11,617,452 B2
(45) Date of Patent: Apr. 4, 2023

(54) SLEEP APPARATUS FOR INFANTS AND METHOD

(71) Applicant: Halo Innovations, Inc., Brooklyn, NY (US)

(72) Inventors: Amy Goldsmith, Brooklyn, NY (US); Jessica Macari, Brooklyn, NY (US)

(73) Assignee: Halo Innovations, Inc., Brooklyn, NY (US)

( * ) Notice: Subject to any disclaimer, the term of this patent is extended or adjusted under 35 U.S.C. 154(b) by 0 days.

(21) Appl. No.: 17/374,236

(22) Filed: Jul. 13, 2021

(65) Prior Publication Data

US 2022/0007851 A1 Jan. 13, 2022

(30) Foreign Application Priority Data

Jul. 13, 2020 (EP) ..... 20185575

(51) Int. Cl.
*A47D 7/02* (2006.01)

(52) U.S. Cl.
CPC ..... *A47D 7/02* (2013.01)

(58) Field of Classification Search
CPC ... A47D 7/00; A47D 7/02; A47D 9/00; A47D 13/02; A47D 13/063
See application file for complete search history.

(56) References Cited

U.S. PATENT DOCUMENTS 9,962,012 B1 * 5/2018 Schmid ..... A47D 9/00
2013/0185867 A1 * 7/2013 Long ..... A47D 13/083 5/100
2019/0099012 A1 4/2019 Zhang et al.

OTHER PUBLICATIONS

Extended European Search Report issued in corresponding European Application No. 20185575.6, dated Oct. 9, 2020, 7 pages.

* cited by examiner

*Primary Examiner* — Fredrick C Conley
(74) *Attorney, Agent, or Firm* — Hamre, Schumann, Mueller & Larson, P.C.

(57) ABSTRACT

A sleep apparatus for an infant comprises an upstanding enclosure surrounding a sleeping platform. The enclosure has front and rear walls, the front wall being moveable between an upper position for preventing the infant from rolling off the sleeping platform and a lower position allowing access to the infant. A biasing mechanism biases the front wall to return automatically in to the upper position in the absence of a barrier to upward movement, and a latch automatically engages when the front wall is in its upper position. The latch prevents movement of the front wall from the upper position towards the lower position until and unless the latch is released.

10 Claims, 10 Drawing Sheets

SLEEP APPARATUS FOR INFANTS AND METHOD

FIELD OF THE INVENTION

The invention relates to an apparatus providing a sleep area for infants, such as a crib or bassinet, and a method for operating the apparatus. The apparatus may for example be used as in an over-the-bed arrangement or as a by-the-bed arrangement, or in any other arrangement.

BACKGROUND OF THE INVENTION

Cribs and bassinets are examples of apparatus used to provide a sleep area for an infant, such as a new-born baby. They are commonly used close to but separate from a parent's bed, but may be used in any situation. Such apparatus should provide a safe place for a new-born baby to sleep while allowing easy and safe access for the mother to the baby, for example for nursing or breastfeeding. For example, a crib or bassinet typically has a floor portion, or sleep platform, on which a baby can sleep, surrounded by upstanding walls to prevent the baby from falling out. Recorded statistics indicate that significant numbers of babies are injured due to falls from beds and other sleeping places both in hospitals and in the home.

A traditional bassinet has a rigid wall surrounding the floor portion. Rigid walls keep a baby securely in the bassinet but impede access to the baby. A prior-art bassinet illustrating one approach to improve access to the baby is described in U.S. Pat. No. 9,962,012 B1. In this bassinet, a front wall portion (the portion of the wall closest to the mother in use) is movable between upper and lower positions and is biased (for example by a resilient spring) towards the upper position. When a mother wishes to pick up the baby, she can simply press down on the front wall portion and move it towards the lower position, in order to gain easier access. This is an improvement over the traditional bassinet, particularly when used in an over-the-bed bassinet. With a bassinet positioned over her bed, a mother lying in the bed may find it difficult to reach over the fixed wall of a traditional bassinet to pick up her baby. However, there is a risk that the movable wall of the bassinet of U.S. Pat. No. 9,962,012 B1 could be lowered by accident, for example by a tired or sleeping mother moving in the bed. There is then a risk that the baby may roll out of the bassinet.

SUMMARY OF INVENTION

The invention provides an apparatus providing a sleep area for infants and a method for operating the apparatus as defined in the appended independent claims, to which reference should now be made. Preferred or advantageous features of the invention are set out in dependent claims.

Advantageously, the invention may thus provide an apparatus comprising an upstanding enclosure surrounding a sleeping platform for an infant such as a baby. The enclosure may comprise front and rear walls, with the front wall moveable between an upper position for preventing the baby from rolling off the sleeping platform and a lower position allowing easier access to the baby. A biasing mechanism biases or urges the front wall to return automatically to the upper position in the absence of a barrier to upward movement. However, when the biasing mechanism returns the front wall to its upper position, the upward motion of the wall, driven by the biasing mechanism, automatically actuates a latch. The latch retains the front wall securely in its upper position and prevents movement of the front wall from the upper position towards the lower position. The latch is manually releasable in order to allow downward motion of the front wall, when next required. Thus, in order to access the baby, the latch can be operated and the front wall depressed, against the action of the biasing mechanism.

As noted above, an apparatus such as a crib or bassinet may most commonly be used by a mother of a new-born baby, who may be extremely tired and can benefit enormously from assistance from easy-to-use and robust but failsafe apparatus to help her look after her baby. Under such circumstances, it is important to ensure that the apparatus operates as simply as possible but that the mother does not accidentally or unintentionally lower the front wall of the apparatus.

It is therefore highly desirable to combine the latch with the upwardly-biased front wall. An upwardly-biased front wall can conveniently be operated, for example by the mother resting her arms on the front wall, and then the front wall is automatically held down by the weight of the mother's arms and/or the weight of the baby while, for example, the mother feeds the baby. When the mother places the baby back in the crib or bassinet, the upwardly-biased front wall can then move into its upper position.

Advantageously, therefore, the invention synergistically combines the latch and the upwardly-biased front wall, by enabling the upward bias of the front wall automatically to re-engage the latch. Embodiments of the invention may therefore advantageously combine the fail-safe operation of the latch with the convenience of the upwardly-biased front wall.

Further preferred aspects of the invention, as described below, additionally enhance the robustness of the apparatus of the invention while retaining its ease of operation, particularly enabling one-handed operation.

In a preferred embodiment, the apparatus providing a sleep area for infants, such as a crib or bassinet, may comprise first and second wall supports extending upwardly at opposite sides or ends of the sleeping platform, or otherwise suitably positioned at edges of the sleeping platform. First and second ends of the front wall may then be pivotably mounted at the first and second wall supports for rotation between upper and lower positions of the front wall. For example, an upper portion of the front wall may comprise a frame or rail, and a lower portion of the front wall may comprise a flexible wall portion connecting the frame or rail to an edge of the sleeping platform beneath the wall. In that case, first and second ends of the frame may be pivotably mounted at the first and second wall supports, and the frame may be rotatable, or pivotable, to move the front wall between the upper and lower positions.

Preferably, the latch may comprise a pivot-release mechanism located in at least one of the first and second wall supports. The latch prevents downward rotation of the front wall from its upper position, but the pivot-release mechanism can release the latch and allow downward pivoting, or rotation, of the front wall. Depending on the rigidity of the front wall, it may be sufficient to have a latch and a pivot-release mechanism located in only one of the first and second wall supports. For example, if the front wall is of rigid construction, then downward motion of the front wall may be prevented by latching only one of its pivots. But preferably, for additional stability and security, there is a latch and a pivot-release mechanism located in both wall supports. Providing a latch and pivot-release mechanism in both wall supports may advantageously improve the robustness of the apparatus and its front wall.

The latch may then comprise a manually-operable control coupled to the or each pivot-release mechanism. The manually-operable control may advantageously be located on the frame or rail, for convenient access, and may then be coupled by cables or bars extending within the frame or rail to the or each pivot-release mechanism.

If the apparatus comprises two latch and pivot-release mechanisms, one in each wall support, one option would be to provide a manually-operable control for each pivot-release mechanism, but in a preferred embodiment the apparatus may comprise only one manually-operable control to operate both pivot-release mechanisms. This may advantageously enable one-handed operation to release the latches retaining the front wall in its upper position, allowing a mother to operate the manually-operable control while having one hand free, for example to hold the baby.

The or each manually-operable control of the latch may for example comprise a slider or slide block which slides to operate the latch, for example by applying forces to cables or bars linking the slider to the or each pivot-release mechanism. For additional security, the or each manually-operable control may further comprise an interlock, such as a resiliently-mounted push button which must be pressed to release the slider.

In further aspects, the invention may advantageously provide methods for operating an apparatus providing a sleep area for infants as defined herein, for example a method comprising the steps of operating the latch and moving the front wall from the upper position to the lower position to access a baby in the apparatus.

DETAILED DESCRIPTION OF EMBODIMENTS OF THE INVENTION

Embodiments of the invention will now be described by way of example, with reference to the accompanying drawings in which.

Figure 1:
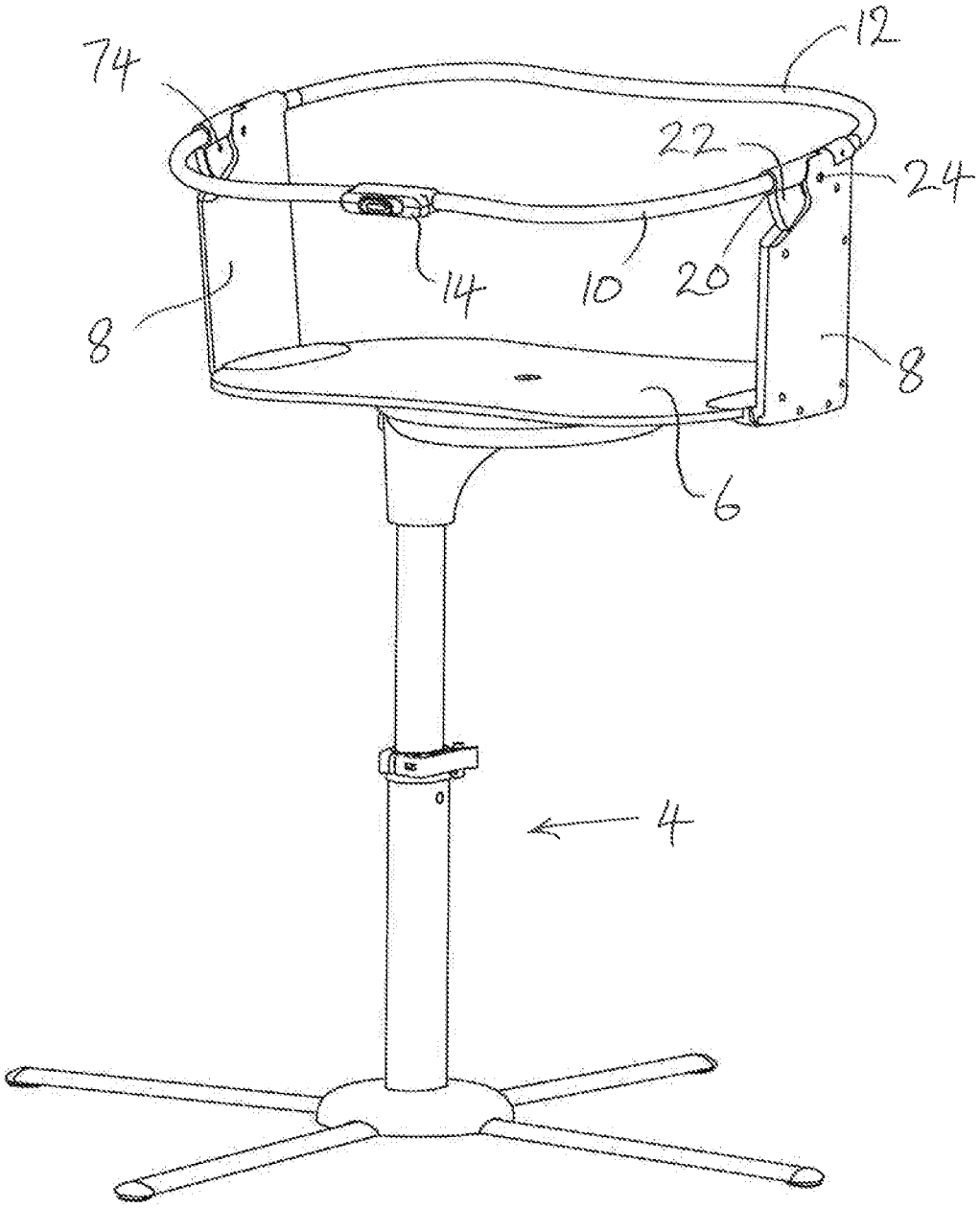
FIG. 1 is a three-quarter view of an apparatus according to a first embodiment of the invention, in the form of a bassinet.

FIG. 1 illustrates an apparatus providing a sleep area for an infant, in the form of a bassinet 2, according to a first embodiment of the invention. The bassinet is supported on a floor-standing frame 4, which is connected to the centre of a floor portion 6 of the bassinet. The bassinet is pivotably supported on the frame, and the height of the frame is adjustable, so that the bassinet can easily be positioned for over-the-bed use or by-the-bed use.

A sleeping platform or mattress may be received on the floor portion of the bassinet. Rigid wall supports 8 extend upwardly from opposite ends of the floor portion and support, at their upper ends, rigid frames or rails 10, 12 which form the upper edges of front and rear walls. The rigid frames are formed from shaped metal tubes. Flexible wall elements (not shown) extend downwardly from the rigid frames to edges of the floor portion beneath, to form an upstanding wall encircling the floor portion and any sleeping platform or mattress placed thereon. The flexible wall elements may, for example, be formed of see-through netting.

Figure 2:
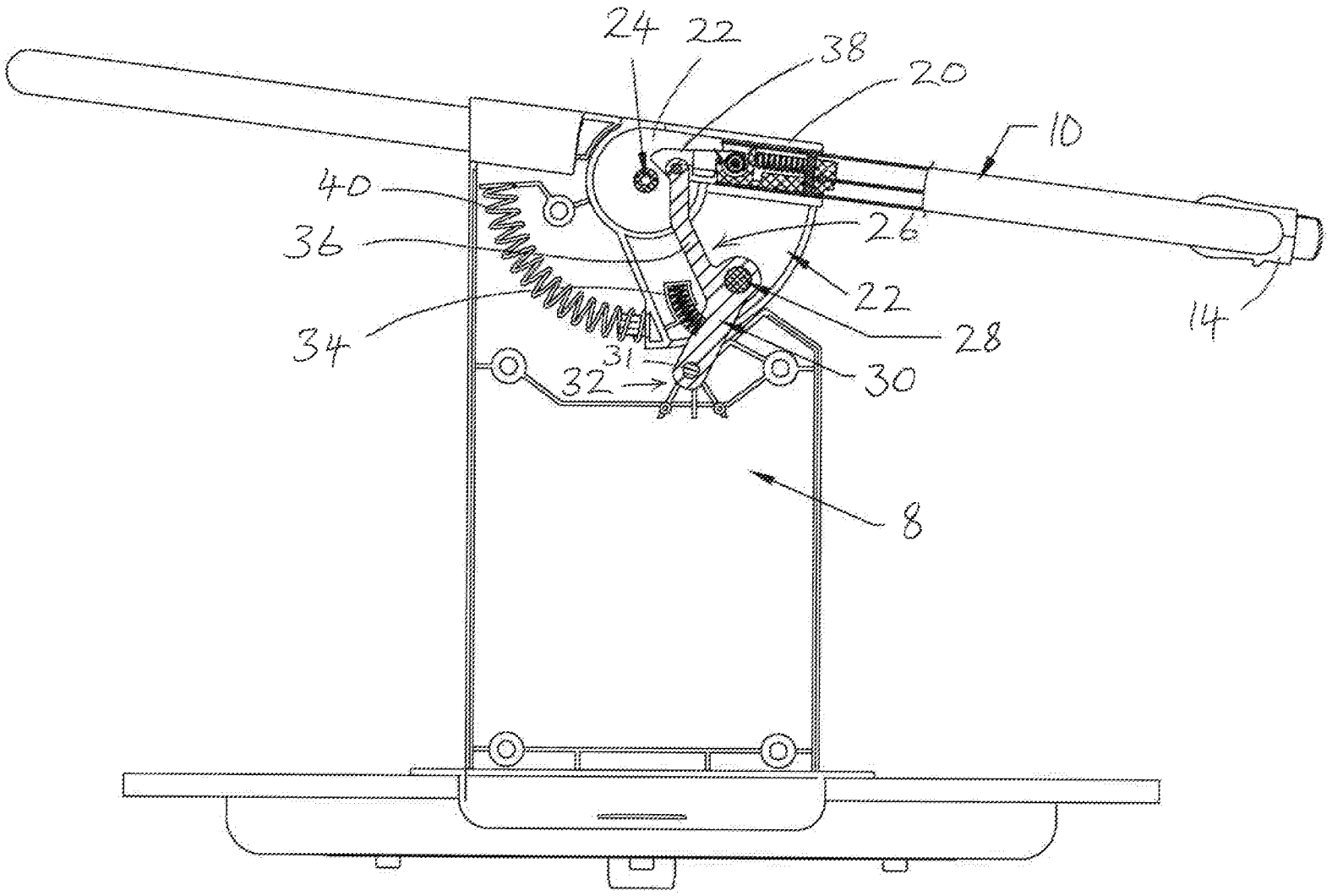
FIG. 2 is a partial vertical section of a wall support of the bassinet of FIG. 1, showing the pivot-release mechanism engaged.
Figure 3:
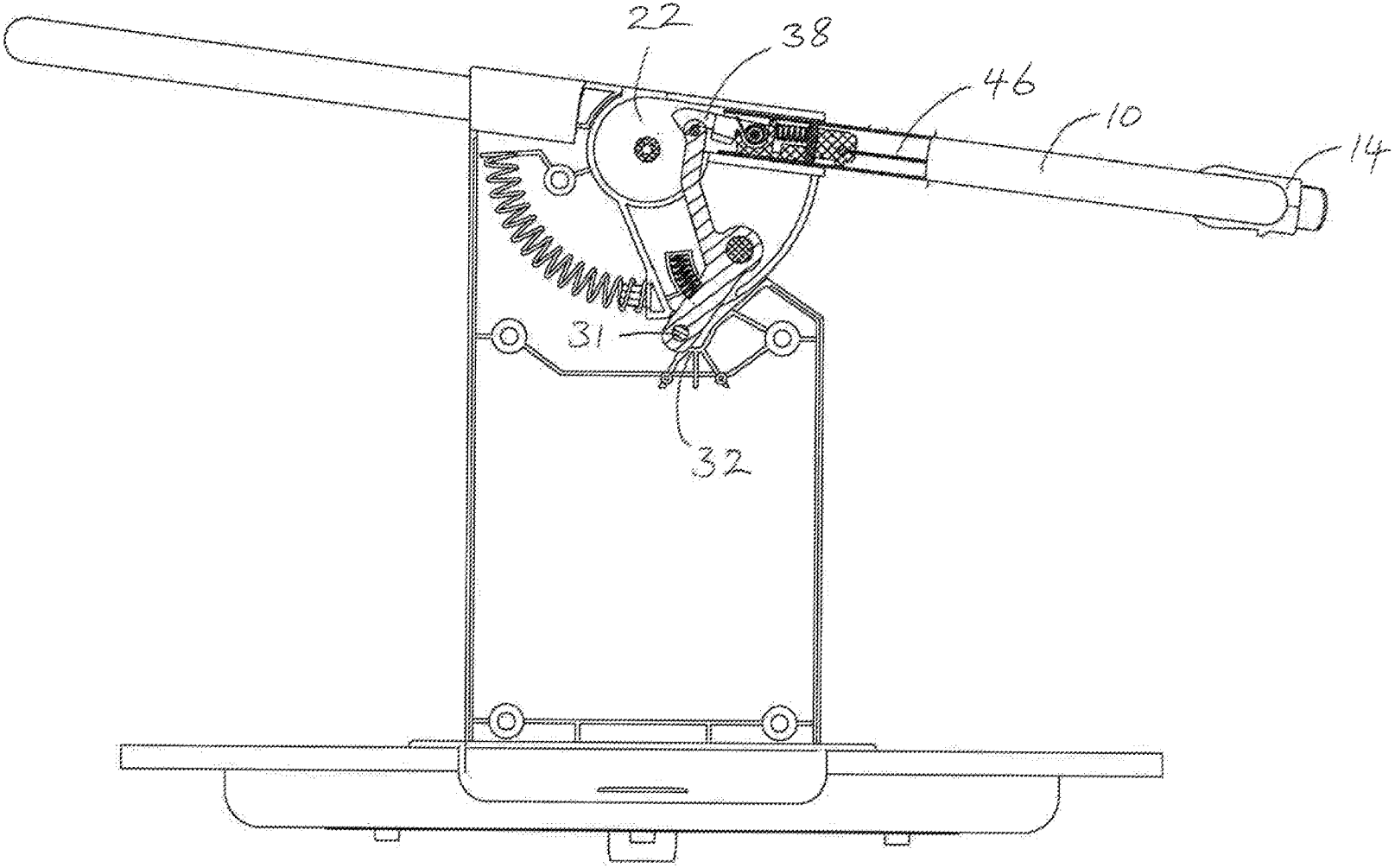
FIGS. 3 and 4 are partial vertical sections corresponding to FIG. 2 and showing the pivot-release mechanism disengaged and movement of a front wall to a lower position.
Figure 4:
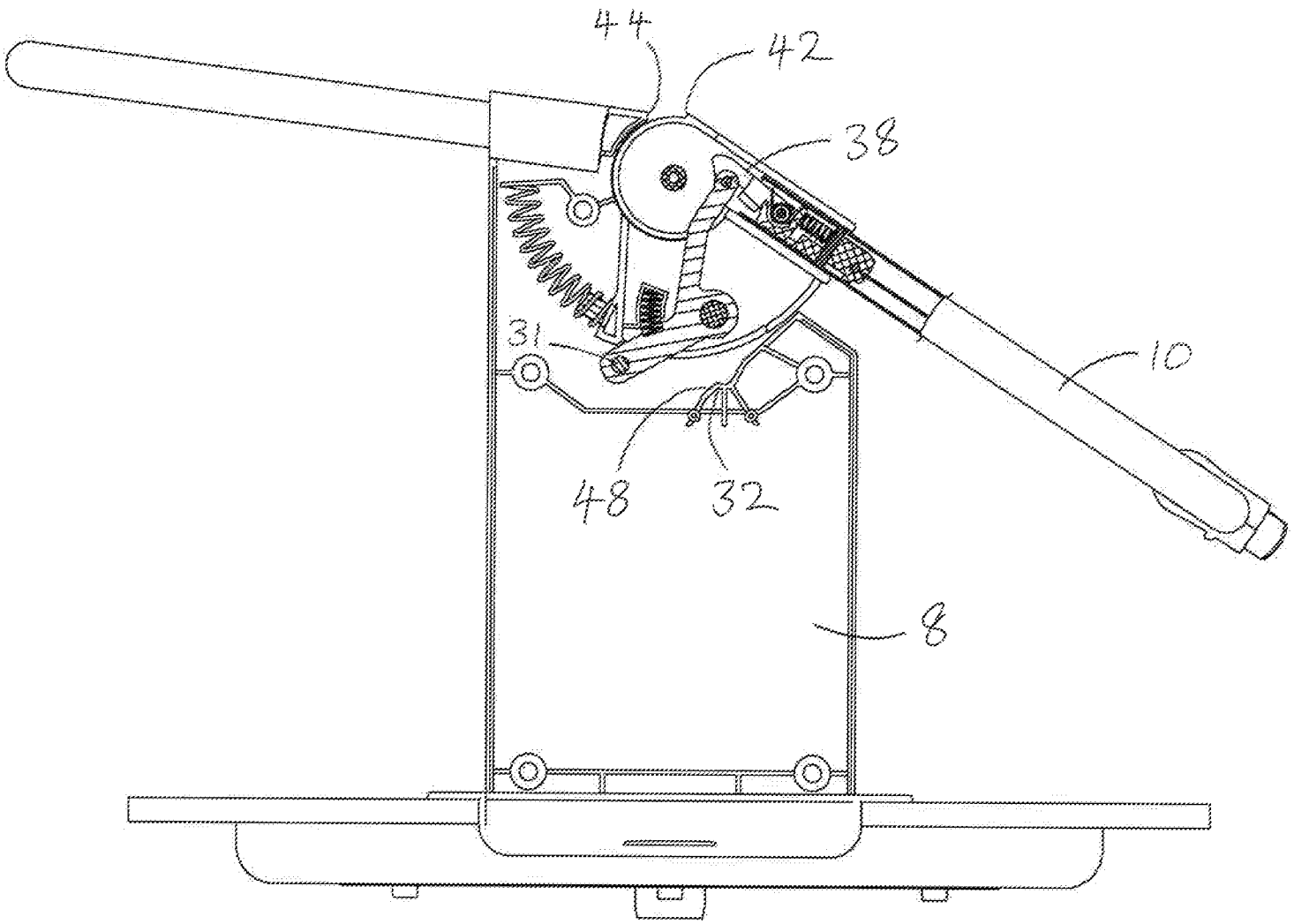

The rigid frames 10, 12 are inclined, so that in use the front wall 10 is lower than the rear wall 12. The rear wall is rigidly secured to the wall supports, and the front wall is pivotably secured to the wall supports, for pivoting or rotation between an upper position as shown in FIGS. 1 to 3 and a lower position as shown in FIG. 4. In its upper position the front wall is latched, by latches in each wall support, to prevent its movement. A manually-operable latch control 14 is centrally located on the frame of the front wall for releasing the latches as described below. In its lower position, the reduced height of the front wall allows easier access for a mother to reach a baby in the bassinet.

FIG. 2 shows in section the structure of the pivoting mounting of the front wall to one of the wall supports 8. (FIG. 2 illustrates the left-hand support in FIG. 1, but the same structure is present in both wall supports.)

An end of the front-wall frame 10 is received in a cylindrical socket 20 of a pivoting frame-support 22. The frame support is retained by and pivotable about a horizontal first stub axle 24 extending from and fixed to the wall support 8.

The pivoting frame-support 22 is resiliently biased by a first coil spring 40 towards a position in which the front-wall frame is in its upper position. The coil spring 40 acts between the wall support and the pivoting frame-support. (In FIG. 2, the coil spring urges the pivoting frame-support in an anticlockwise direction.) Upward motion of the front-wall frame is limited by the abutment of corresponding portions 42, 44 of the pivoting frame-support and the wall support, most clearly seen in FIG. 4.

A pivot-release lever 26 is retained by and rotatable about a horizontal second stub axle 28, which extends from the pivoting frame-support. The first and second stub axles are parallel to each other. The pivot-release lever comprises upper and lower arms. The lower arm 30 extends downwardly and carries at its lower end a transverse latching bar 31 which is engageable with a fixed seat 32 of the wall support 8. A second coil spring 34 acts between the pivoting frame-support and the lower arm 30, and urges the latching bar 31 into automatic engagement with the fixed seat 32 when the front-wall frame is in its upper position. Engagement of the latching bar 31 with the fixed seat 32 latches the front-wall frame in its upper position and prevents downward motion of the front-wall frame by preventing rotation of the pivoting frame-support 22 about the first stub axle 24.

The upper arm 36 of the pivot-release lever extends upwardly from the second stub axle and engages, at its upper end, with a hook 38 which is slidably mounted in, and secured to, the end of the front-wall frame received in the pivoting-frame-support socket 20. Engagement of the hook with the upper arm of the pivot-release lever prevents withdrawal of the front-wall frame from the socket.

Figure 5:
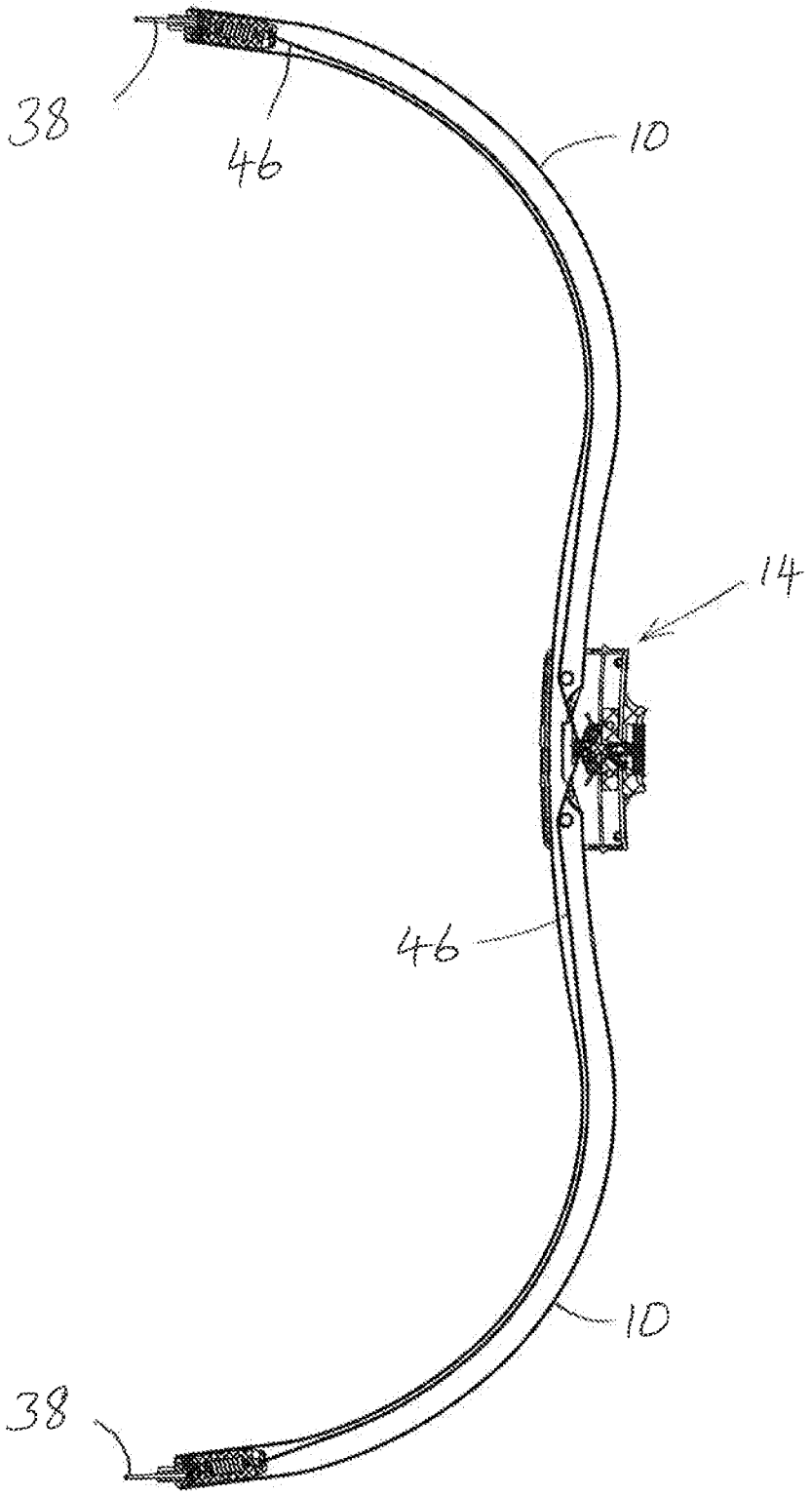
FIGS. 5 to 7 are horizontal sections of a frame or rail portion of the front wall of the first embodiment, showing stages of the operation of a manually-operable control.
Figure 6:
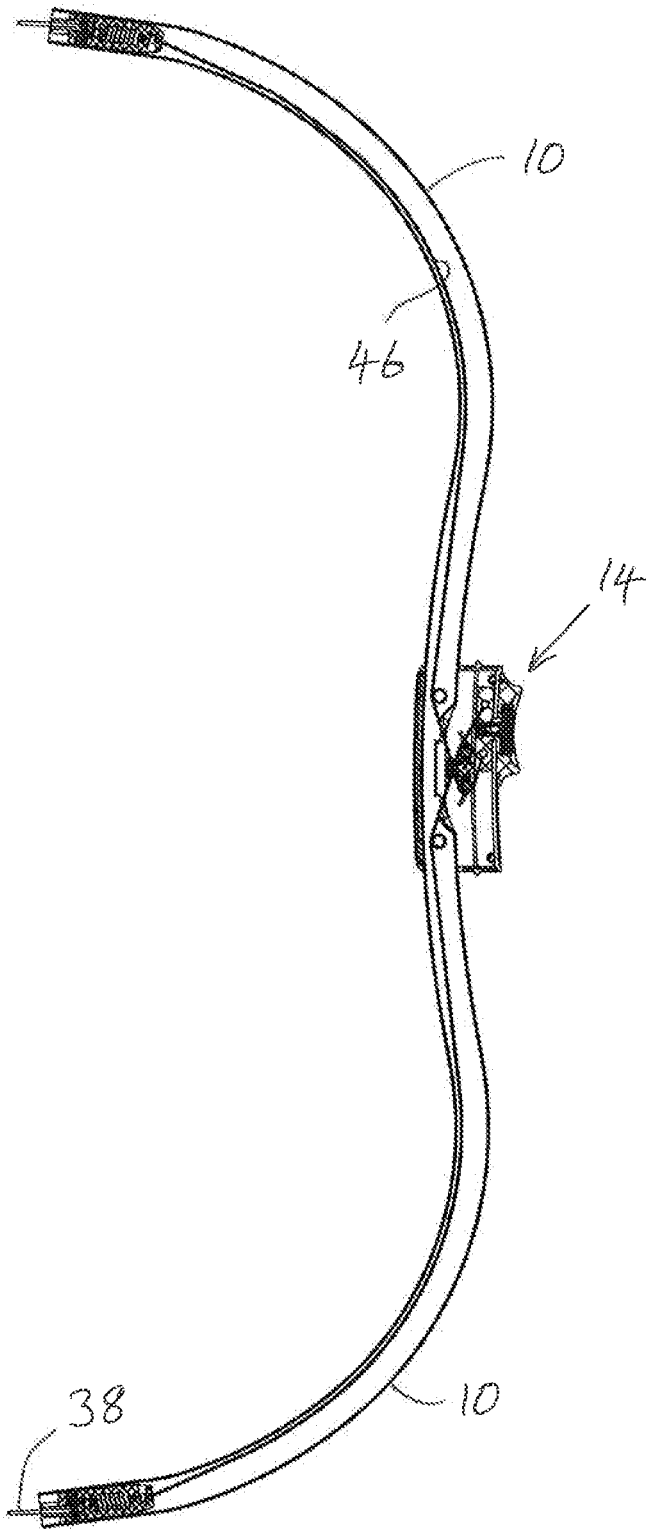
Figure 7:
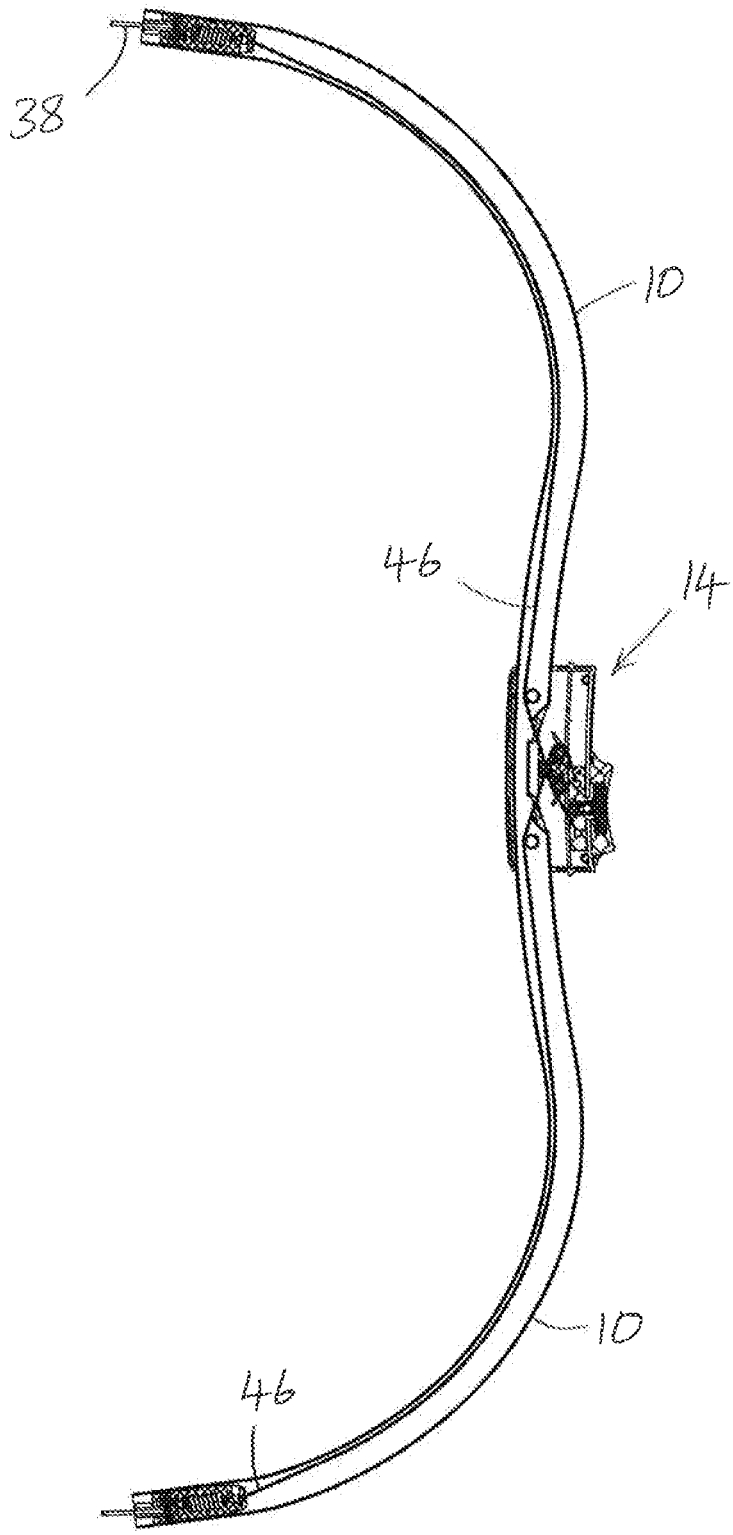

As shown in FIGS. 5 to 7, a similar hook is slidably mounted in each of the two ends of the front-wall frame, and engaged with a corresponding pivot-release lever at each wall support.

FIGS. 3 and 4 illustrate the lowering of the front-wall frame and the front wall from its upper position, in which it retains the baby safely in the bassinet, to a lower position to improve access to the baby. When the front-wall frame is in its upper position, it is automatically latched as illustrated in FIG. 2, at both wall supports, by the engagement of the latching bar 31 of the pivot-release lever with the fixed seat 32 of the wall support. To release the latches, the manually-operable latch control 14 is actuated as described in more detail below.

The manually-operable control 14 is coupled by two cables 46 to the two hooks 38, which are slidably mounted at respective ends of the front-wall frame. When the latch control is operated, the cable draws each hook a short distance into the frame. This movement of each hook acts on the upper arm 36 of the corresponding pivot release lever 26, rotating the lever about the second stub axle 28 and moving the latching bar 31 of the lever out of engagement with the fixed seat 32. This position is illustrated in FIG. 3. This unlatches the front-wall frame.

After operation of the manually-operable latch control, the front-wall frame remains in its upper position, held by the biasing force exerted by the coil spring 40. However, downward pressure on the front-wall frame can act against the biasing force and move the front-wall frame towards its lower position, as illustrated in FIG. 4. For example, downward pressure may be applied by the mother's arms reaching to pick up the baby.

When downward pressure is removed from the front-wall frame, the biasing force exerted by the first coil spring 40 (in each wall support) is sufficient automatically to raise the front-wall frame into its upper position. As the front-wall frame approaches its upper position, the lower arm 30 of the pivot-release lever contacts a cam surface 48 adjacent to the fixed seat 32. As the pivoting frame-support 22 rotates further under the influence of the first coil spring, the latching bar 31 travels along the cam surface, rotating the pivot-release lever and gradually compressing the second coil spring 34. When the latching bar 31 reaches the end of the cam surface, the compressed second coil spring automatically rotates the lower arm of the pivot release lever so that the latching bar 31 engages with the fixed seat, in both wall supports, positively latching and securing the front-wall frame in its upper position.

The relative forces applied by the first and second coil springs 40, 34 to the pivoting frame-support and the pivot-release lever, and the angle of the cam surface 48, are predetermined in order to ensure that when the front-wall frame is released, it automatically rises into its upper position and latches securely.

FIGS. 5, 6 and 7 are horizontal sections of the front-wall frame 10 illustrating the interaction between the manually-operable latch control 14 and the hooks 38 at each end of the front-wall frame.

Figure 12:
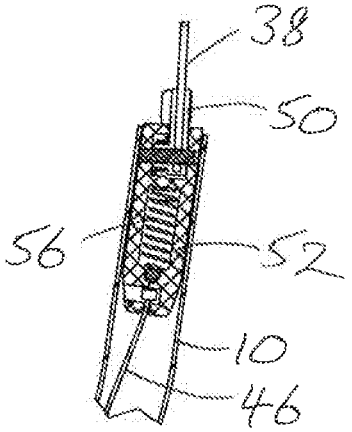
FIG. 12 is a lateral section of a latch hook of FIGS. 5 to 7.
Figure 13:
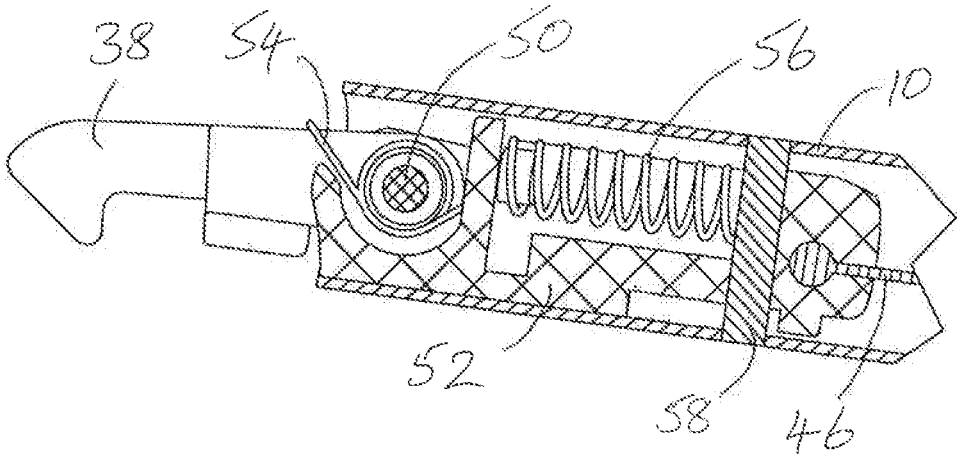
FIGS. 13 and 14 are vertical sections of the latch hook of FIG. 12 showing movement of the hook as the pivot-release mechanism is operated.
Figure 14:
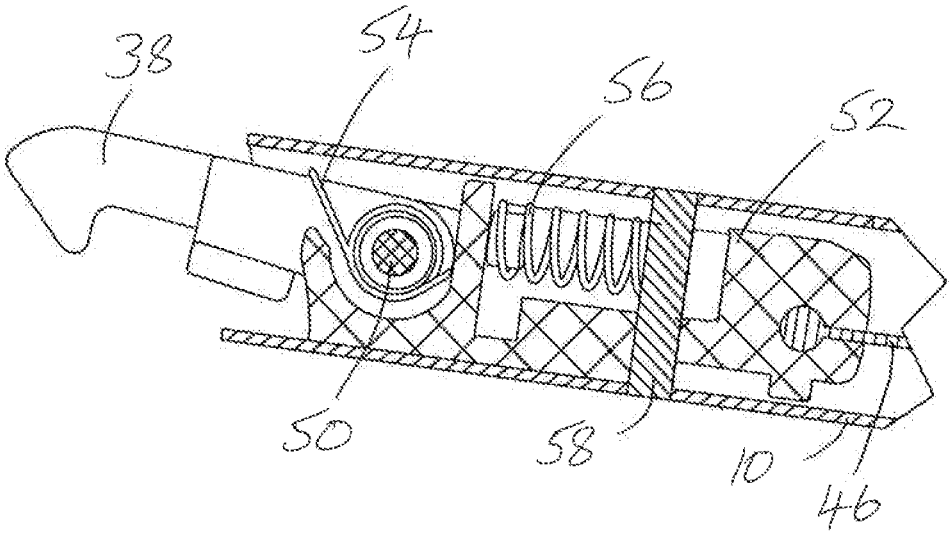

One of the hooks 38 is illustrated in FIGS. 12 to 14. The hook is mounted on a pivot 50 at an end of a cylindrical hook carrier 52, which is slidably retained by a clip 58 within an end of the metal tube forming the front-wall frame 10. The hook is urged (anticlockwise in FIGS. 13 and 14) into an engaged position by a hook spring 54 acting around the pivot 50. The carrier 52 is connected to the cable 46 which extends within the metal tube of the front-wall frame and couples the hook to the manually-operable latch control. An end of the cable is seated in a recess in the cylindrical carrier. The hook further comprises a coil spring which bears on the clip 58 to bias the hook carrier in a direction out of the end of the frame tube, to assist with returning the hook carriers to the correct position after the manually-operable control has been released.

Figure 8:
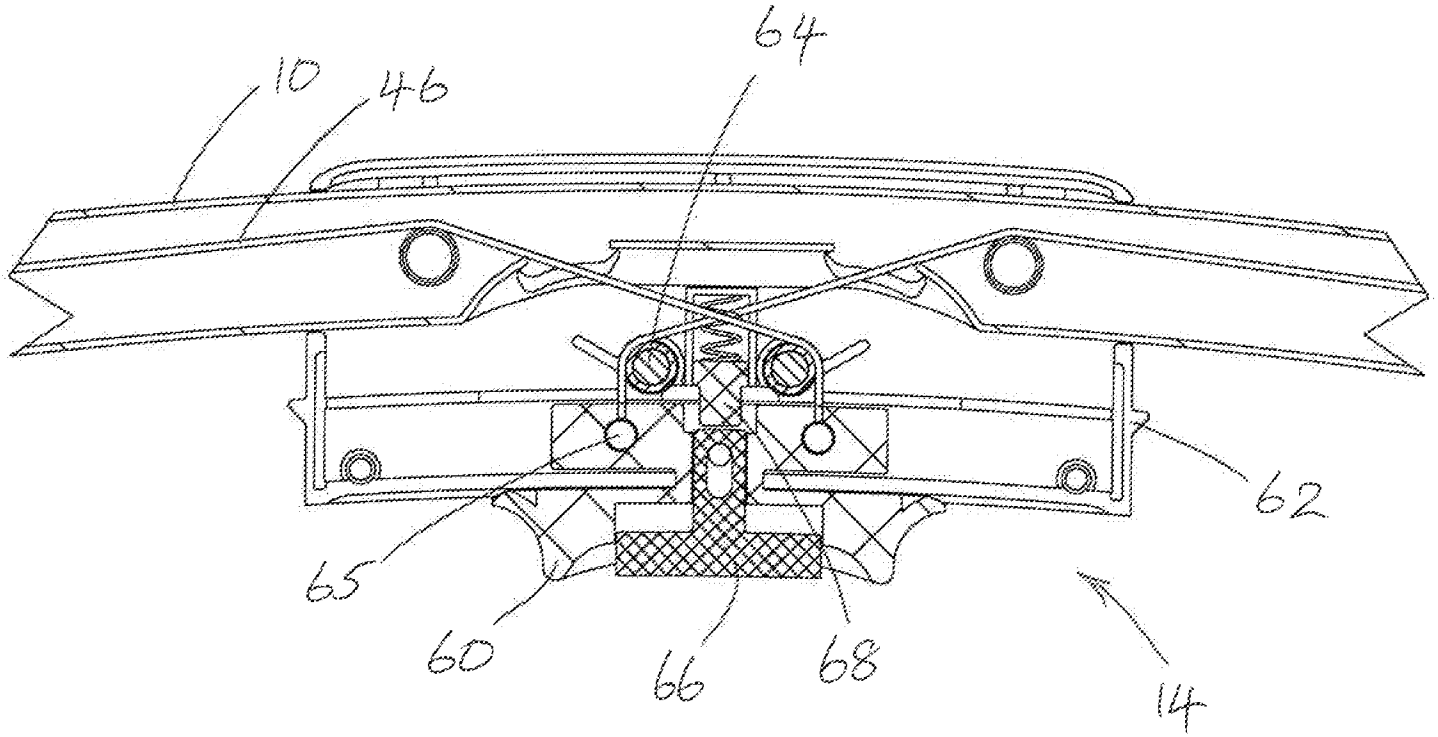
FIG. 8 is a lateral section of the manually-operable control.
Figure 9:
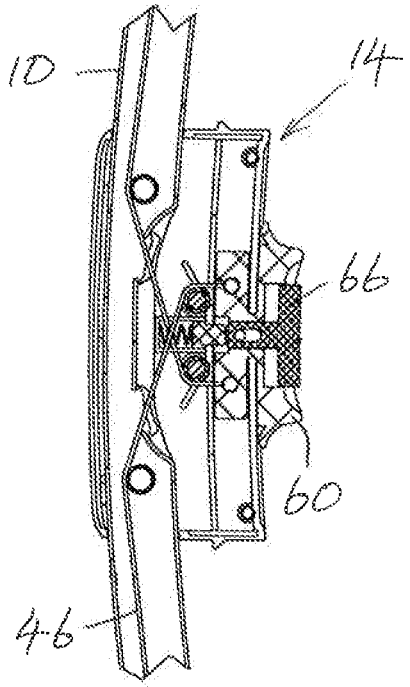
FIGS. 9 to 11 are lateral sections of the manually-operable control in three stages of operation corresponding to FIGS. 5 to 7.
Figure 10:
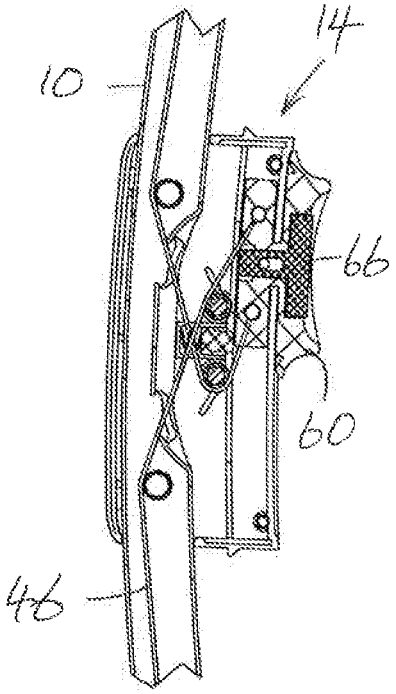
Figure 11:
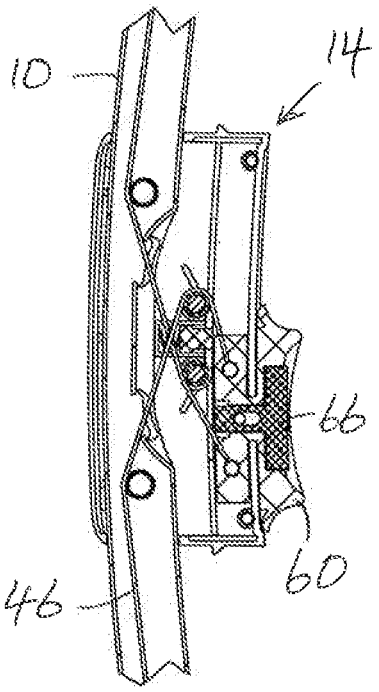

The structure of the manually-operable latch control 14 is illustrated in FIG. 8, and its operation is shown in more detail in FIGS. 9 to 11. The latch positions in FIGS. 9 to 11 correspond to the latch positions in FIGS. 5 to 7.

The latch control comprises a slider 60 which is movable both left and right in a housing 62. The housing is secured to the front-wall frame 10. The cables 46, which are coupled at their other ends to the hook carriers, pass around axles 64 and are connected at the cable ends 65 to the slider so that motion of the slider in either direction pulls on both of the cables and draws both of the hooks, supported on their carriers, into the ends of the front-wall frame. As described above in relation to FIGS. 2 to 4, drawing the hooks into the ends of the front-wall frame rotates the pivot-release levers against the biasing action of the pivot-release coil springs 34. Consequently, when the slider is released, the pivot-release coil springs urge the hooks to slide partially out of the ends of the front-wall frame, pulling on the cables and returning the latch-control slider to its central position.

The latch control further comprises a pushbutton 66 which is carried by the slider. When the slider is in its central position, the pushbutton is aligned with and acts on a spring-loaded peg, or lock block, 68, which is mounted in the housing 62 and engages with the slider to prevent lateral movement of the slider. When the pushbutton is pressed, it moves the spring-loaded peg out of engagement with the slider and allows lateral movement of the slider. When the slider returns to its central position, the spring-loaded peg automatically re-engages with the slider, locking its sliding movement.

FIGS. 5, 8 and 9 show the slider in its central position, the spring-loaded peg 68 engaged with the slider, and the hooks 38 at each end of the front-wall frame 10 fully extended from the frame. FIGS. 6 and 10 show the pushbutton depressed and the slider at a right-hand end of its travel. The slider has pulled on the cables and withdrawn the hooks into the ends of the front-wall frame. FIGS. 7 and 11 show the pushbutton depressed and the slider at a left-hand end of its travel. Again, the slider has pulled on the cables and withdrawn the hooks into the ends of the front-wall frame.

As the hooks slide within the ends of the frame, and drive rotation of the pivot-release levers, the hooks rotate through a small angle about the pivots 50 on which they are mounted, between the positions shown in FIGS. 13 and 14 and in FIGS. 2 to 4. This movement accommodates the rotation of the upper arms 36 of the pivot-release levers 26 about the second stub axles 28. The action of the hook springs 54 urging the hooks into engagement with the upper arms of the pivot-release levers ensures that the hooks remain securely engaged with the pivot-release levers during the latching and unlatching actions of the mechanism.

The invention claimed is:

1. An apparatus providing a sleep area for an infant, comprising;

an upstanding enclosure surrounding a sleeping platform for an infant, the enclosure comprising a front wall moveable between an upper position for preventing the infant from rolling off the sleeping platform and a lower position allowing access to the infant;

a biasing mechanism biasing the front wall to return automatically to the upper position in the absence of an external force applied to it, in use, by an operator; and a latch, which is configured to automatically engage when the front wall automatically returns to the upper position from the lower position, for preventing movement of the front wall from the upper position towards the lower position until the latch has been released.

2. An apparatus according to claim 1, further comprising first and second wall supports at opposed sides or ends of the sleeping platform, first and second ends of the front wall being pivotably mounted at the first and second wall supports for rotation between the upper and lower positions.

3. An apparatus according to claim 2, in which the latch comprises a pivot-release mechanism located in at least one of the first and second wall supports.

4. An apparatus according to claim 3, in which the latch comprises a pivot-release mechanism in each wall support.

5. An apparatus according to claim 3, in which the latch comprises a manually-operable control coupled to the or each pivot-release mechanism.

6. An apparatus according to claim 5, in which the latch comprises a pivot-release mechanism in each wall support, and a single manually-operable control coupled to both pivot-release mechanisms.

7. An apparatus according to claim 5, in which the front wall comprises a frame, and the manually-operable control is located on the frame, and is coupled by cables or rods extending within the frame to each pivot-release mechanism.

8. An apparatus according to claim 7, in which the frame forms an upper portion of the front wall, and a lower portion of the front wall comprises a flexible wall portion connecting the frame to an edge of the sleeping platform beneath the wall.

9. An apparatus according to claim 1, further comprising a manually-operable control operably connected to the latch, the manually-operable control comprises a slider which is configured to operate the latch, and a resiliently-mounted pushbutton which is configured to be pressed to release the slider.

10. A method for operating an apparatus providing a sleep area for an infant as defined in claim 1, comprising the steps of operating the latch and moving the front wall from the upper position to the lower position to access the infant, and releasing the front wall and allowing it to return to its upper position and automatically to latch in the upper position.

* * * * *